US011682370B2

(12) United States Patent
Labbe et al.

(10) Patent No.: US 11,682,370 B2
(45) Date of Patent: Jun. 20, 2023

(54) MUSICAL INSTRUMENT PICK

(71) Applicant: Acoustik Attak, Inc., Westport, CT (US)

(72) Inventors: Mark Labbe, Westport, CT (US); Michael DePietro, Plandome Manor, NY (US)

(73) Assignee: Acoustik Attak, Inc., Westport, CT (US)

( * ) Notice: Subject to any disclaimer, the term of this patent is extended or adjusted under 35 U.S.C. 154(b) by 0 days.

(21) Appl. No.: 17/453,880

(22) Filed: Nov. 8, 2021

(65) Prior Publication Data

US 2022/0059061 A1 Feb. 24, 2022

Related U.S. Application Data

(63) Continuation of application No. 16/883,509, filed on May 26, 2020, now Pat. No. 11,170,744.

(51) Int. Cl.
*G10D 3/173* (2020.01)

(52) U.S. Cl.
CPC ..... *G10D 3/173* (2020.02)

(58) Field of Classification Search
CPC ..... G10D 3/173; G10D 3/00
See application file for complete search history.

(56) References Cited

U.S. PATENT DOCUMENTS

| | | | | |
|---|---|---|---|---|
| 4,993,301 | A | 2/1991 | de los Santos | |
| 5,610,349 | A | 3/1997 | William et al. | |
| 7,462,768 | B2 | 12/2008 | Newmaster | |
| 9,576,561 | B2 * | 2/2017 | Thompson | G10D 3/173 |
| 2006/0081109 | A1 | 4/2006 | James | |
| 2015/0206516 | A1 | 7/2015 | Thompson | |

OTHER PUBLICATIONS

International Search Report for PCT Application No. PCT/2021/032228, dated Aug. 17, 2021.

* cited by examiner

*Primary Examiner* — Kimberly R Lockett
(74) *Attorney, Agent, or Firm* — Taylor English Duma LLP

(57) ABSTRACT

A pick for plucking a string of a stringed musical instrument is provided. The pick includes a planar body having front and rear sides, a distal end having a curved tip for plucking the string, a proximal end for gripping by a user; and a plurality of raised formations provided on at least one of the front and rear sides of the planar body at the distal end, the raised formations being structured and arranged at the distal end to strike the string more than once when the distal end plucks the string.

18 Claims, 11 Drawing Sheets

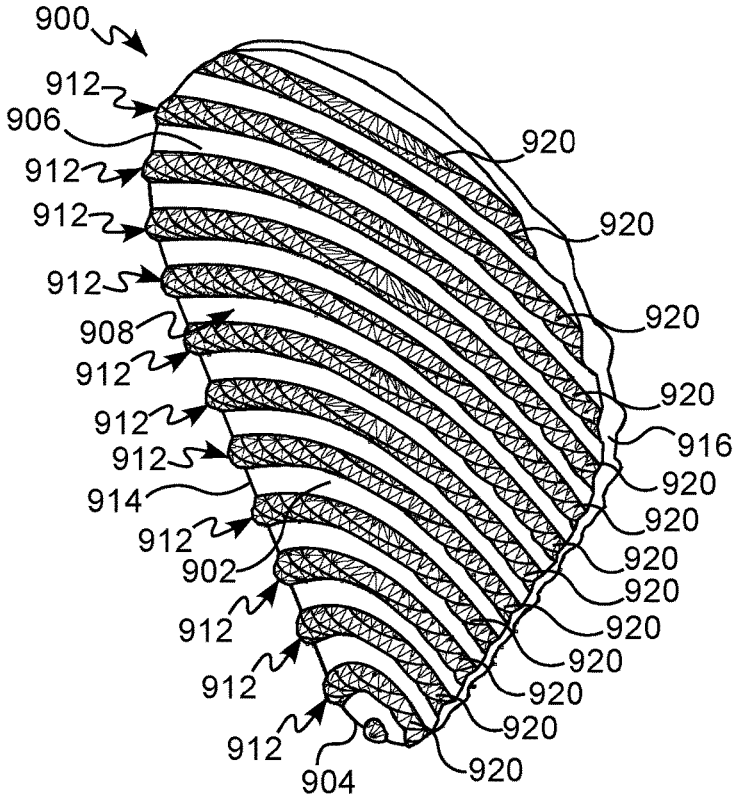
FIG. 9A
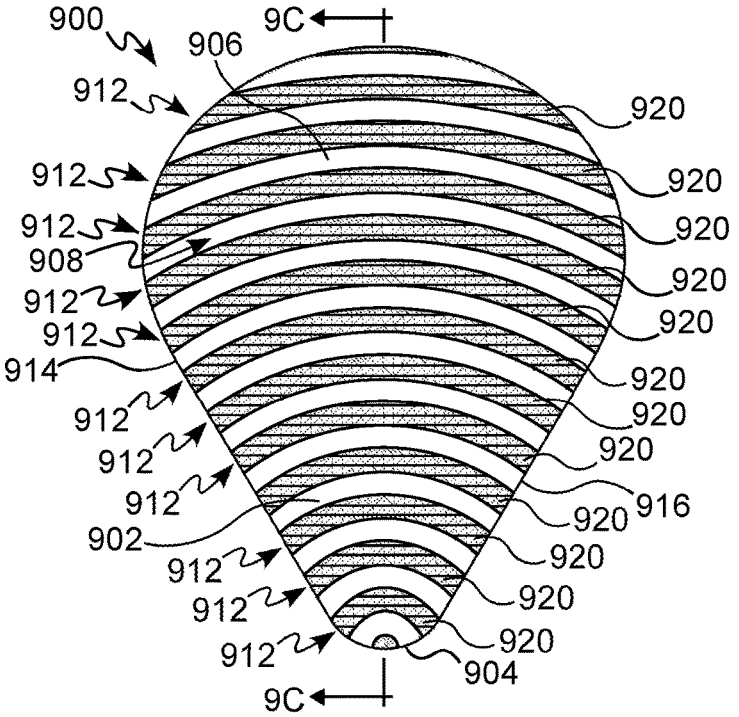
FIG. 9B
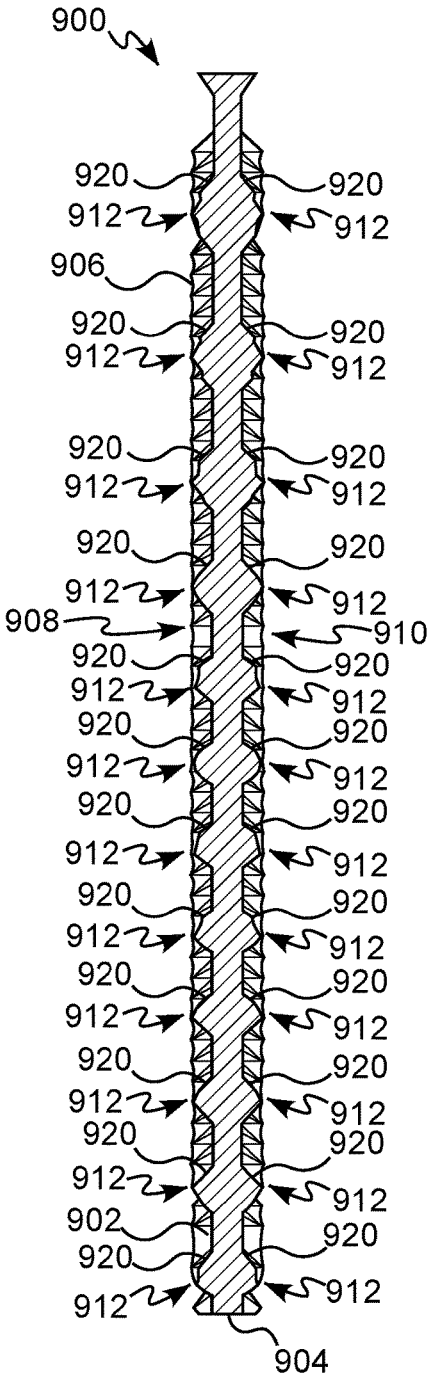
900
920
912
906
920
912
920
912
920
912
908
920
912
920
912
920
912
920
912
920
912
920
912
920
912
920
912
920
912
902
920
912
904
920
912
906
920
912
920
912
920
912
920
912
920
912
920
912
920
912
920
912
920
912
920
912
920
912
920
912
920
912
920
912
910
920
912
920
912
920
912
920
912
920
912
920
912
920
912
920
912
920
912
920
912
920
912
920
912
920
912
920
912

MUSICAL INSTRUMENT PICK

CROSS-REFERENCE TO RELATED APPLICATIONS

This application is a continuation of U.S. patent application Ser. No. 16/883,509, filed May 26, 2020, and entitled "MUSICAL INSTRUMENT PICK," the disclosure of which is incorporated by reference herein in its entirety for all purposes.

The exemplary embodiments of present invention relate generally to accessories for stringed musical instruments (e.g., a guitar or the like) and, more specifically, to picks for playing stringed musical instruments.

BACKGROUND OF THE DISCLOSURE

Using a flat-tipped plectrum or pick to pluck a musical instrument string produces two pulse waves that propagate in both directions down the string from the "pluck point." When the pulses reach the endpoints of the string, they reverse and combine with each other to create a standing wave with zero displacement at the nodes (destructive interference) and maximum displacement between the nodes (constructive interference). There exists a need for a pick that can alter this typical standing wave to produce desirous sound enhancements.

BRIEF SUMMARY OF THE DISCLOSURE

Various exemplary embodiments of the subject disclosure provide picks with raised formations on their front and/or rear surfaces. The raised formations include, without limitation, ridges, bumps, or protruding elements of textures or mathematically derived surfaces. The raised formations cause a pattern of multiple strikes of a string in a single pluck, thereby generating multiple different pulse waves that propagate along the string with different frequencies and amplitudes and at different times. This produces greater complexity in the superposition of waves compared to a simple standing wave produced by prior art picks which, in turn, leads to sound enhancements, such as desirous harmonics, frequency enhancements (such as filling in mid-range, high-range or other ranges of frequencies), destructive or constructive interference patterns of sound waves, one or more percussive effects, etc.

The sound enhancement(s) produced by the formations may depend at least in part on the number of formations, placement of the formations, shape of the formations, and/or dimensions of the formations (such as width and/or height), as well as playing speed. Construction and placement of the formations may also be determined, for example, by mathematical formulae or equations for producing a desired sound enhancement, such as z=sin(sqrt(x*x+y*y)), though use of mathematical formulae or equations is neither necessary nor required by various embodiments of the subject disclosure.

The lateral projection distance from the planar body of a pick or "height" of each formation may also be selected to achieve a desired sound enhancement. Formations may have the same or different heights, such as, for example, increasing or decreasing heights as measured from the curved tip proximally toward a proximal end of the pick, though it should be appreciated that various embodiments of the subject disclosure are not intended to be limited to any specific height(s) or height patterns. For example, in one embodiment, any number of formations may project laterally from either side of a pick to a height of about 0.3 mm to 2.5 mm, such as, e.g., 0.3, 0.4, 0.5, 0.6, 0.7, 0.8, 0.9, 1.0. 1.1, 1.2, 1.3, 1.4, 1.5, 1.6, 1.8, 1.9, 2.0, 2.1, 2.2, 2.3, 2.4 or 2.5 mm.

A desired sound enhancement may also be produced by changing the angle of attack of a pick relative to the string which, in turn, alters the sequence, manner and/or speed by which the raised formations strike the string. FIG. 11B, for example, shows a pick 1100 with a side edge 1116 striking a string 1105 at a 45-degree angle of attack, compared to a typical 0-degree angle of attack shown in FIG. 11A.

Exemplary picks contemplated by the subject disclosure may also exhibit any shape, such as a substantially isosceles triangular shape, and have any suitable thickness, such as a thickness ranging from about 0.3 mm to 2.5 mm or more, such as, e.g., 0.3, 0.5, 0.6, 0.7, 0.8, 0.9, 1.0, 1.1, 1.2, 1.3, 1.4, 1.5, 1.6, 1.7, 1.8, 1.9, 2.1, 2.2, 2.3, 2.4 or 2.5 mm, though it should be appreciated that various embodiments of the subject disclosure are not intended to be limited to any specific thickness(es). Exemplary picks may also range from substantially flexible to substantially rigid, depending on desired sound enhancement(s), and be constructed from any suitable materials, such as, for example, unreinforced plastic, reinforced plastic and metal, though it should be appreciated that other suitable material(s) may be used.

In accordance with one embodiment of the subject disclosure, a pick for plucking a string of a stringed musical instrument is provided. The pick includes a planar body having front and rear sides, a distal end having a curved tip for plucking the string, a proximal end for gripping by a user; and a plurality of raised formations provided on at least one of the front and rear sides of the planar body at the distal end, the raised formations being structured and arranged at the distal end to strike the string more than once when the distal end plucks the string.

In accordance with another embodiment of the subject disclosure, each of the plurality of raised formations projects laterally from the distal end to a height of about 1.0 to 2.5 mm.

In accordance with still another embodiment of the subject disclosure, the plurality of raised formations is provided on substantially an entirety of at least one of the front and rear sides.

In accordance with yet another embodiment of the subject disclosure, the plurality of raised formations includes curved or sloped leading surfaces to facilitate substantially unhindered passage of the raised formations over the string.

In accordance with still another embodiment of the subject disclosure, the raised formations are of substantially equal height.

In accordance with yet another embodiment of the subject disclosure, the raised formations decrease in height toward the proximal end.

In accordance with still another embodiment of the subject disclosure, the raised formations increase in height toward the proximal end.

In accordance with yet another embodiment of the subject disclosure, the plurality of raised formations includes triangular ridges.

In accordance with still another embodiment of the subject disclosure, the plurality of raised formations includes spheroids.

In accordance with yet another embodiment of the subject disclosure, the spheroids are substantially the same size.

In accordance with still another embodiment of the subject disclosure, the spheroids are different sizes.

In accordance with yet another embodiment of the subject disclosure, a side cross-section of the plurality of raised formations resembles a sinusoidal wave.

In accordance with still another embodiment of the subject disclosure, the sinusoidal wave has a frequency that increases toward the distal end.

In accordance with yet another embodiment of the subject disclosure, the plurality of raised formations includes pyramids.

In accordance with still another embodiment of the subject disclosure, the plurality of raised formations includes stars.

In accordance with yet another embodiment of the subject disclosure, each of the stars are five-pointed stars.

In accordance with still another embodiment of the subject disclosure, the plurality of raised formations includes curved ridges.

In accordance with yet another embodiment of the subject disclosure, the plurality of raised formations includes randomly arranged bumps.

Other features and advantages of the subject disclosure will be apparent from the following more detail description of the exemplary embodiments.

BRIEF DESCRIPTION OF THE SEVERAL VIEWS OF THE DRAWINGS

The foregoing summary, as well as the following detailed description of the exemplary embodiments of the subject disclosure, will be better understood when read in conjunction with the appended drawings. For the purpose of illustrating the present disclosure, there are shown in the drawings, exemplary embodiments. It should be understood, however, that the subject application is not limited to the precise arrangements and instrumentalities shown.

FIG. 9A is a perspective view of a musical instrument pick in accordance with another exemplary embodiment of the subject disclosure;

FIG. 9B is a front elevational view of the musical instrument pick of FIG. 9A;

FIG. 9C is a side elevational view of the musical instrument pick of FIG. 9A;

DETAILED DESCRIPTION OF THE DISCLOSURE

Figure 1A:
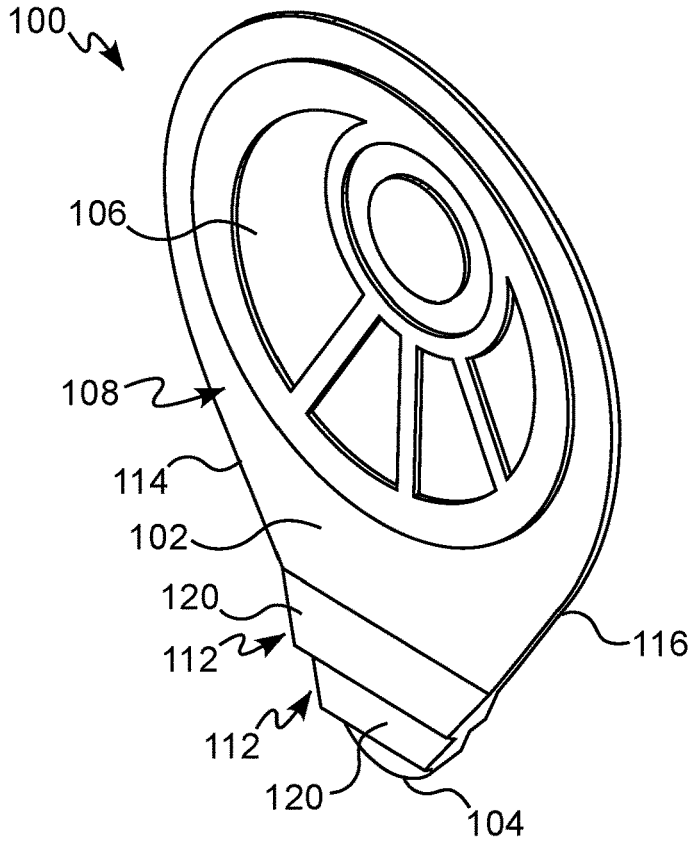
FIG. 1A is a perspective view of a musical instrument pick in accordance with an exemplary embodiment of the subject disclosure.

Reference will now be made in detail to the various exemplary embodiments of the subject disclosure illustrated in the accompanying drawings. Wherever possible, the same or like reference numbers will be used throughout the drawings to refer to the same or like features. It should be noted that the drawings are in simplified form and are not drawn to precise scale. Certain terminology is used in the following description for convenience only and is not limiting. Directional terms such as top, bottom, left, right, above, below and diagonal, are used with respect to the accompanying drawings. The term "distal" shall mean away from the center of a body. The term "proximal" shall mean closer towards the center of a body and/or away from the "distal" end. The words "inwardly" and "outwardly" refer to directions toward and away from, respectively, the geometric center of the identified element and designated parts thereof. Such directional terms used in conjunction with the following description of the drawings should not be construed to limit the scope of the subject application in any manner not explicitly set forth. Additionally, the term "a," as used in the specification, means "at least one." The terminology includes the words above specifically mentioned, derivatives thereof, and words of similar import.

"About" as used herein when referring to a measurable value such as an amount, a temporal duration, and the like, is meant to encompass variations of ±20%, ±10%, ±5%, ±1%, or ±0.1% from the specified value, as such variations are appropriate.

"Substantially" as used herein shall mean considerable in extent, largely but not wholly that which is specified, or an appropriate variation therefrom as is acceptable within the field of art. "Exemplary" as used herein shall mean serving as an example.

"Exemplary" as used herein shall mean "example" only and is not intended to identify any embodiment or structure as preferred or more desirable than any other.

Throughout the subject application, various aspects thereof can be presented in a range format. It should be understood that the description in range format is merely for convenience and brevity and should not be construed as an inflexible limitation on the scope of the subject disclosure. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 2.7, 3, 4, 5, 5.3, and 6. This applies regardless of the breadth of the range.

Furthermore, the described features, advantages and characteristics of the exemplary embodiments of the subject disclosure may be combined in any suitable manner in one or more embodiments. One skilled in the relevant art will recognize, in light of the description herein, that the subject disclosure can be practiced without one or more of the specific features or advantages of a particular exemplary embodiment. In other instances, additional features and advantages may be recognized in certain embodiments that may not be present in all exemplary embodiments of the present disclosure.

Figure 1B:
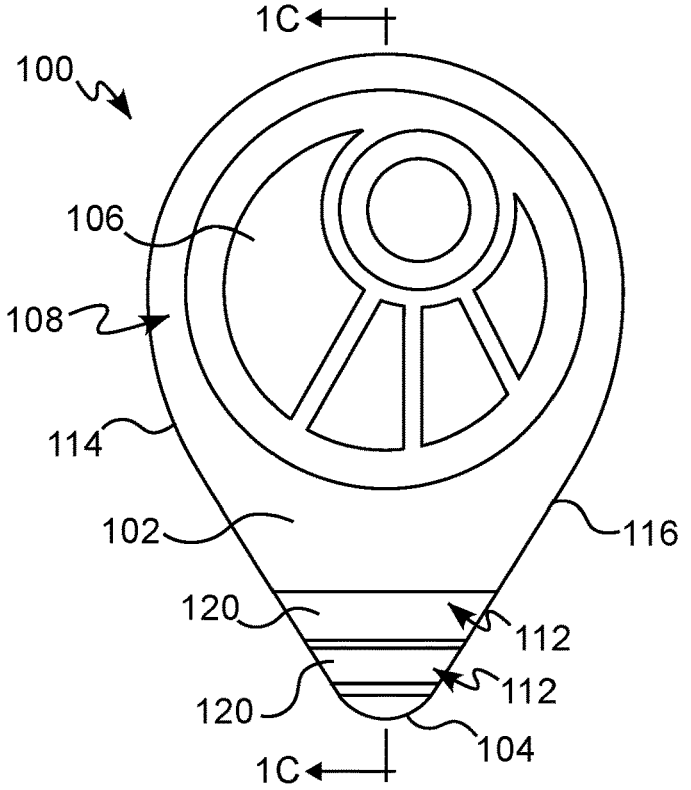
FIG. 1B is a front elevational view of the musical instrument pick of FIG. 1A.
Figure 1C:
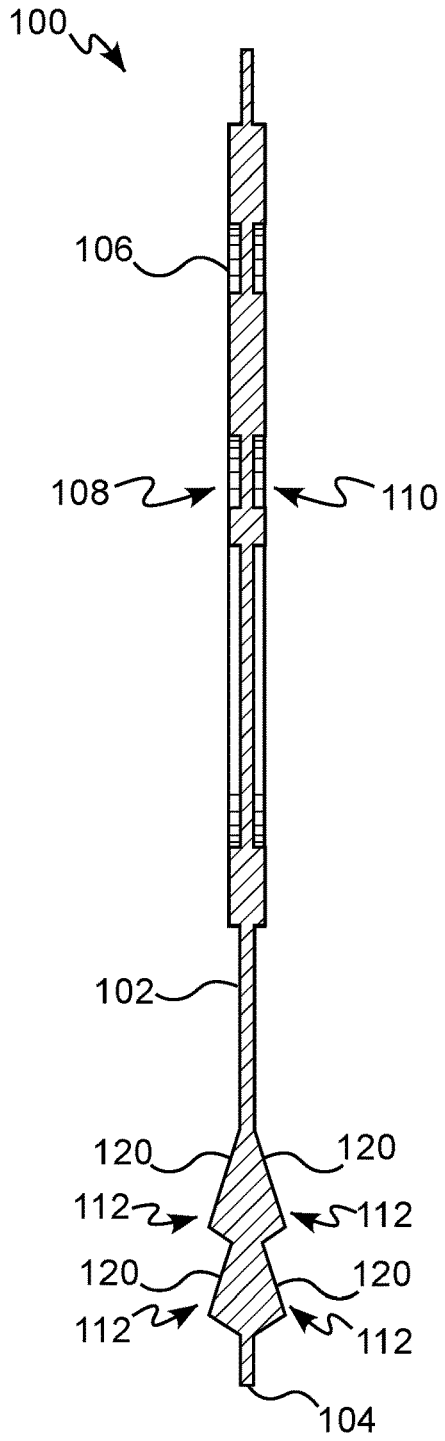
FIG. 1C is a side elevational view of the musical instrument pick of FIG. 1A.

Referring now to the drawings, FIGS. 1A through 1C illustrate an exemplary embodiment of a stringed musical instrument plectrum or pick 100 adapted to be gripped by a user and plucked across a string or strings of a musical instrument such as, for example, a guitar or the like. Pick 100, like other exemplary picks of the subject disclosure, includes a generally planar body having front and rear sides 108, 110, two side edges 114, 116, an acute angled distal end 102 with a curved tip 104, a generally semi-circular proximal end 106 extending proximally from distal end 102, and diametrically opposed raised formations 112 projecting laterally from front and rear sides 108, 110 at distal end 102. Raised formations 112 include two pairs of diametrically opposed and substantially triangular ridges that extend substantially the entire width of pick 100 at or near distal end 102, with each ridge including a gradually sloped and proximally facing leading surface 120 to facilitate substantially unhindered passage of the raised formation 112 over the string being plucked. The ridges of each pair of formations 112 project laterally on opposite sides 108, 110 of the planar body to approximately the same height. In this manner, when either side 108, 110 of pick 100 is used to pluck a string at a 0-degree angle of attack, the four raised formations 112 on that side strike the string four times in rapid succession, thereby producing a desired sound enhancement. A different sound enhancement may be achieved by plucking pick 100 against the string at a different angle of attack to change the sequence, manner and/or speed by which raised formations 112 strike the string.

Although the exemplary pick 100 illustrated in FIGS. 1A through 1C includes a single curved tip 104, it should be appreciated that pick 100 and other exemplary picks of the subject disclosure may include multiple tips (such as, e.g., two tips) and/or tips having any suitable shape, such as, for example, a pointed tip. It should also be appreciated that a pick may include any number of raised formations having any shape, and that various embodiments of the subject disclosure are not intended to be limited to any specific shape or number of raised formations. It should also be appreciated that raised formations may be provided on only one side of a pick or on any portion of a pick, such as, for example, on only the distal end of a pick (e.g., covering an area extending proximally 1 to 1.5 cm from the curved tip of the pick), over the entire surface of either or both sides of a pick, at or near the side edges of a pick, and/or at a mid-portion of a pick, though it should be understood that various embodiments of the subject disclosure are not intended to be limited to any specific placement of raised formations.

Figure 2A:
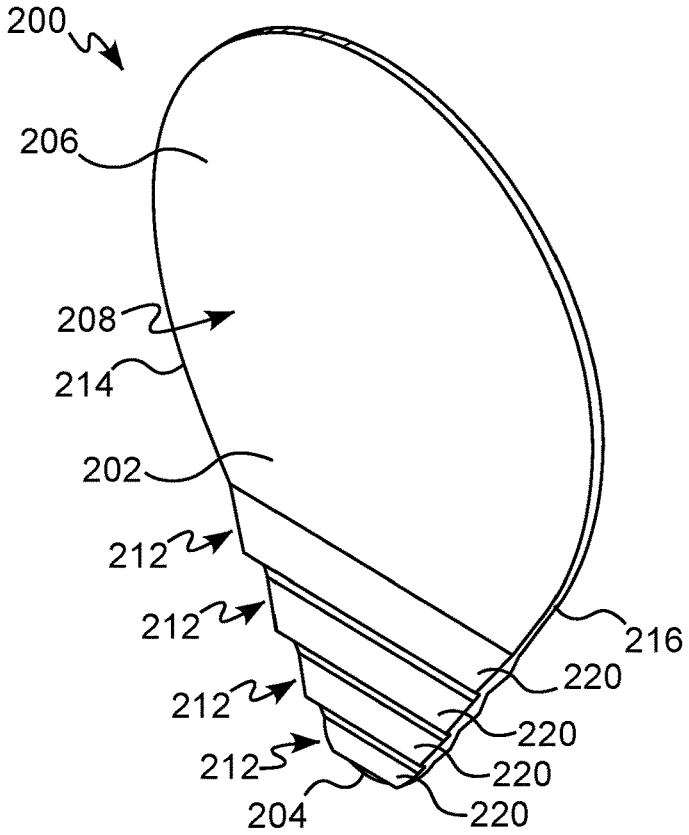
FIG. 2A is a perspective view of a musical instrument pick in accordance with another exemplary embodiment of the subject disclosure.
Figure 2B:
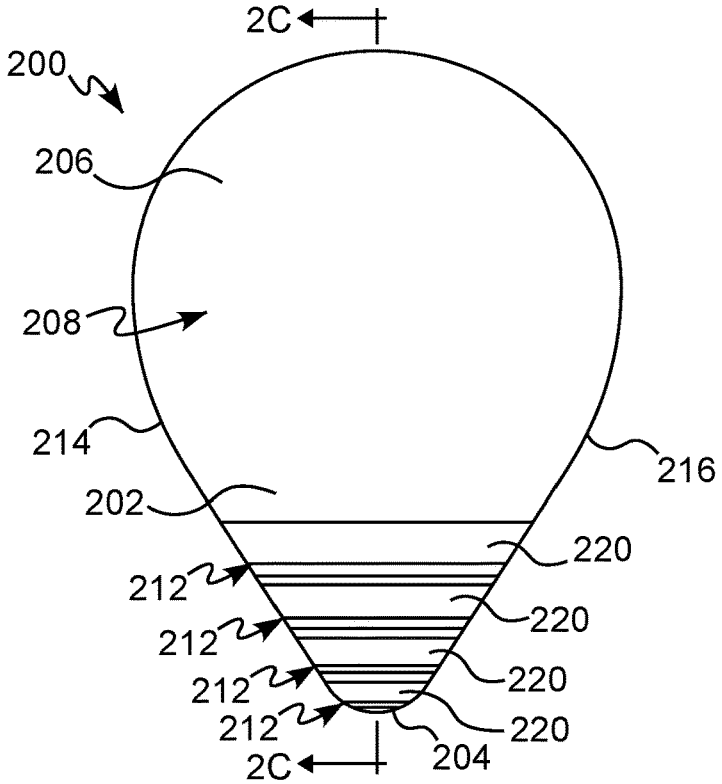
FIG. 2B is a front elevational view of the musical instrument pick of FIG. 2A.
Figure 2C:
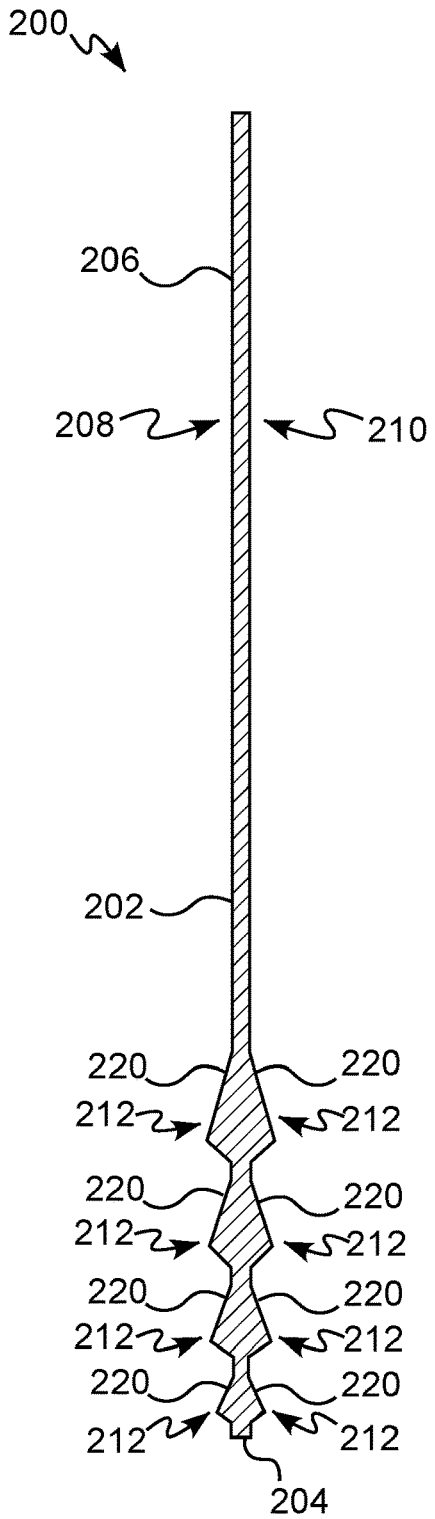
FIG. 2C is a side elevational view of the musical instrument pick of FIG. 2A.

Referring now to FIGS. 2A through 2C, there is seen another exemplary pick 200 in accordance with the subject disclosure. Pick 200 includes a generally planar body having front and rear sides 208, 210, two side edges 214, 216, an acute angled distal end 202 with a curved tip 204, a generally semi-circular proximal end 206 extending proximally from distal end 202, and diametrically opposed raised formations 212 projecting laterally from front and rear sides 208, 210. Raised formations 212 include four pairs of diametrically opposed and substantially triangular ridges on opposite sides 208, 210 that extend substantially the entire width of pick 200 at or near distal end 202, with each ridge including a gradually sloped and proximally facing leading surface 220 to facilitate substantially unhindered passage of the raised formation 212 over the string being plucked. The ridges of each pair of formations 212 project laterally on opposite sides 208, 210 of the planar body to substantially the same height, with each successively proximal pair of formations 212 having an increasing height. In this manner, when either side 208, 210 of pick 200 is used to pluck a string at a 0-degree angle of attack, the four raised formations 212 on that side strike the string four times in rapid succession, thereby producing a desired sound enhancement. A different sound enhancement may be achieved by plucking pick 200 against the string at a different angle of attack to change the sequence, manner and/or speed by which raised formations 212 strike the string.

Figure 3A:
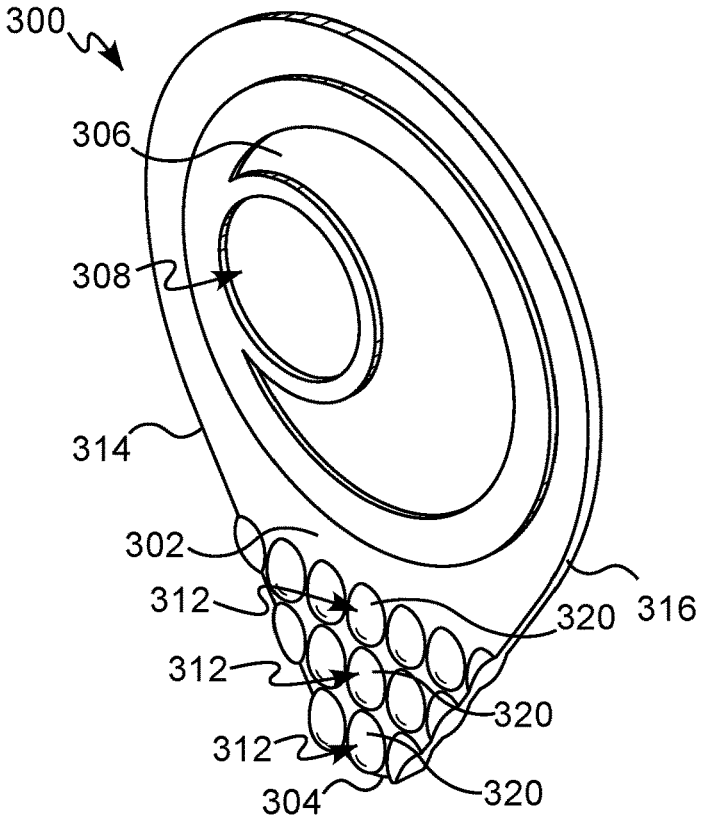
FIG. 3A is a perspective view of a musical instrument pick in accordance with another exemplary embodiment of the subject disclosure.
Figure 3B:
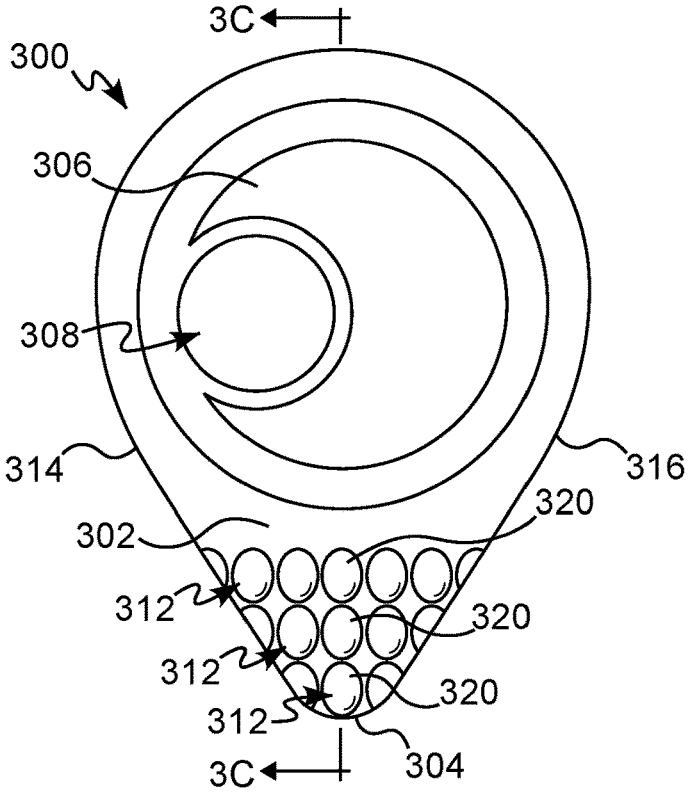
FIG. 3B is a front elevational view of the musical instrument pick of FIG. 3A.
Figure 3C:
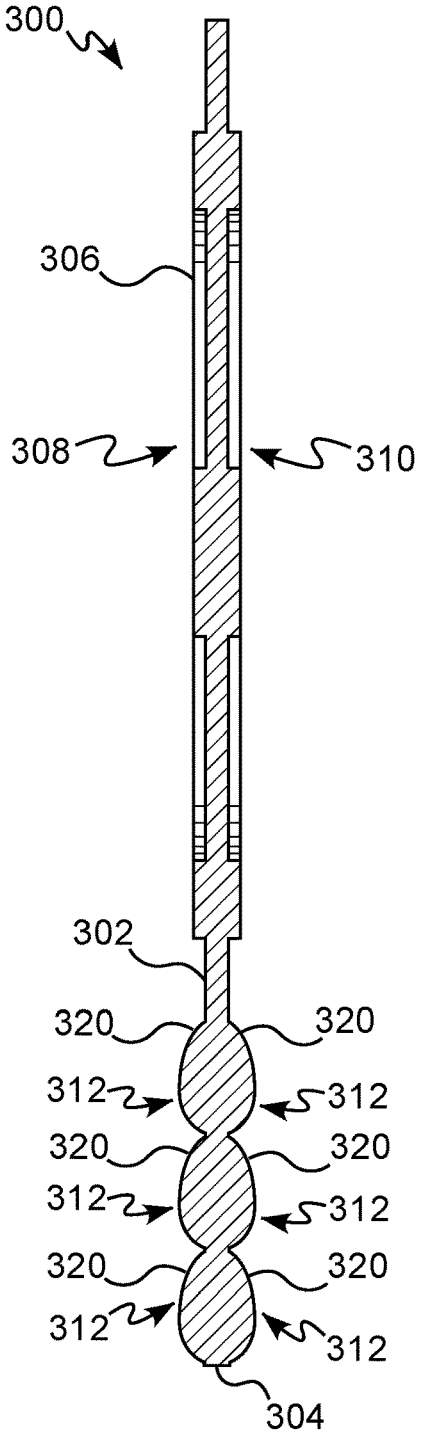
FIG. 3C is a side elevational view of the musical instrument pick of FIG. 3A.

Referring now to FIGS. 3A through 3C, there is seen another exemplary pick 300 in accordance with the subject disclosure. Pick 300 includes a generally planar body having front and rear sides 308, 310, two side edges 314, 316, an acute angled distal end 302 with a curved tip 304, a generally semi-circular proximal end 306 extending proximally from distal end 302, and diametrically opposed raised formations 312 projecting laterally from front and rear sides 308, 310 (three raised formations 312 on each side 308, 310 are referenced in the Figures). Raised formations 312 include three pairs of diametrically opposed rows of spheroids that extend substantially the entire width of pick 300 at or near distal end 302, with each spheroid having a curved leading surface 320 to facilitate substantially unhindered passage of raised formations 312 over the string being plucked. The spheroids project laterally to substantially the same height on both sides 308, 310 of the planar body. In this manner, when either side 308, 310 of pick 300 is used to pluck a string at a 0-degree angle of attack, the three rows of spheroids on that side strike the string three times in rapid succession, thereby producing a desired sound enhancement.

Since each row of raised formations 312 includes multiple spheroids rather than a single contiguous formation, pick 300 may be used to strike the string more than three times and with different strike patterns by changing the angle of attack between pick 300 and the string. For example, if a user plucks the string using a side edge 314, 316 of pick 300, the spheroids will strike the string successively in an alternating and different pattern compared to a pluck of the string at a 0-degree angle of attack. In this manner, pick 300 may be used to provide a variety of different sound enhancements depending on the angle of attack of pick 300 relative to the string being plucked.

Figure 4A:
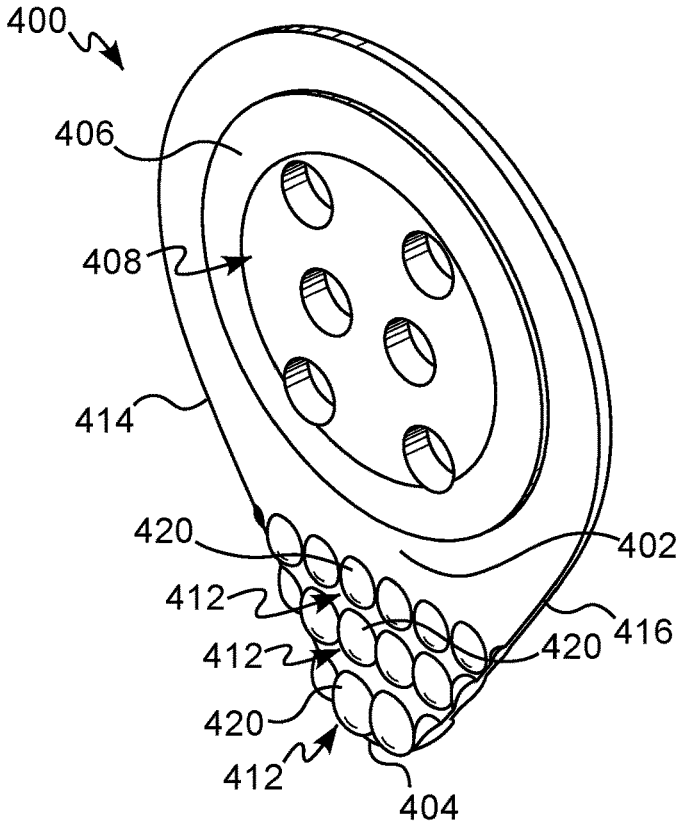
FIG. 4A is a perspective view of a musical instrument pick in accordance with another exemplary embodiment of the subject disclosure.
Figure 4B:
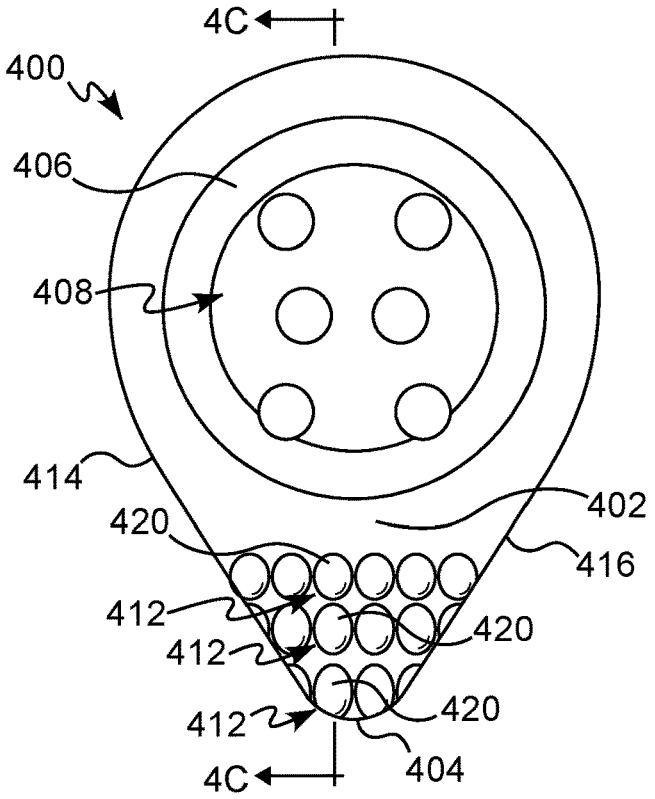
FIG. 4B is a front elevational view of the musical instrument pick of FIG. 4A.
Figure 4C:
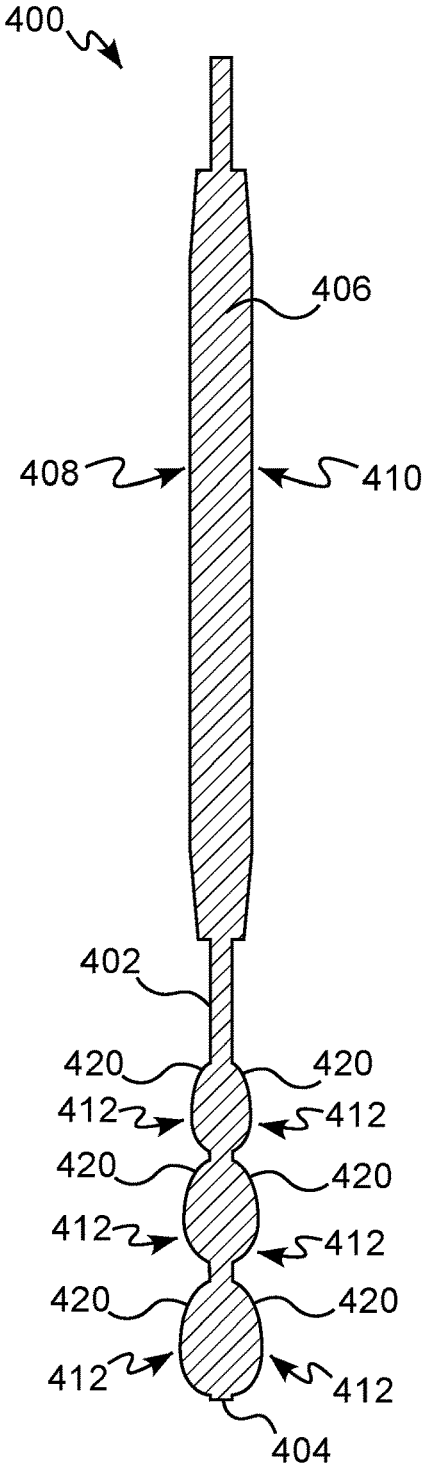
FIG. 4C is a side elevational view of the musical instrument pick of FIG. 4A.

Referring now to FIGS. 4A through 4C, there is seen another exemplary pick 400 in accordance with the subject disclosure. Pick 400 includes a generally planar body having front and rear sides 408, 410, two side edges 414, 416, an acute angled distal end 402 with a curved tip 404, a generally semi-circular proximal end 406 extending proximally from distal end 402, and diametrically opposed raised formations 412 projecting laterally from front and rear sides 408, 410 (three raised formations 412 on each side 408, 410 are referenced in the Figures). Similar to pick 300, raised formations 412 of pick 400 include three pairs of diametrically opposed rows of spheroids that extend substantially the entire width of pick 400 at or near distal end 402, with each spheroid having a curved leading surface 420 to facilitate substantially unhindered passage of raised formations 412 over the string being plucked. The spheroids of each row of formations 412 project laterally on a side 408, 410 of the planar body to substantially the same height, with each successively proximal row of formations 412 on that side 408, 410 having a decreasing height. In this manner, when either side 408, 410 of pick 400 is used to pluck a string at a 0-degree angle of attack, the three rows of spheroids on that side strike the string three times in rapid succession, thereby producing a desired sound enhancement.

Since each row of raised formations 412 of pick 400 includes multiple spheroids rather than a single contiguous formation, pick 400 may be used to strike the string more than three times and with different strike patterns by changing the angle of attack between pick 400 and the string. For example, if a user plucks the string using a side edge 414, 416 of pick 400, the spheroids will strike the string successively in an alternating and different pattern compared to a pluck of the string at a 0-degree angle of attack. In this manner, pick 400 may be used to provide a variety of different sound enhancements depending on the angle of attack of pick 400 relative to the string being plucked.

Figure 5A:
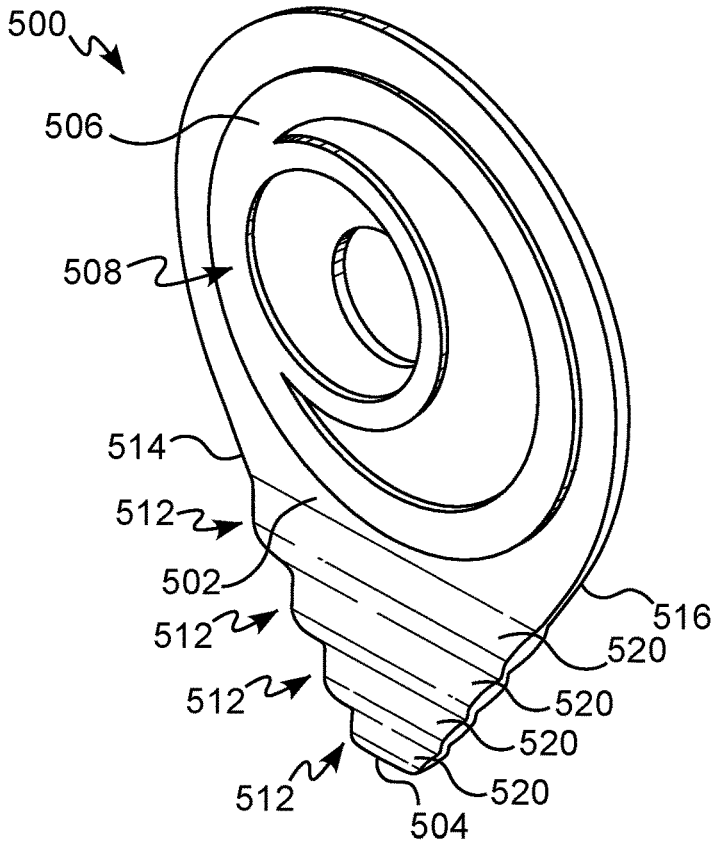
FIG. 5A is a perspective view of a musical instrument pick in accordance with another exemplary embodiment of the subject disclosure.
Figure 5B:
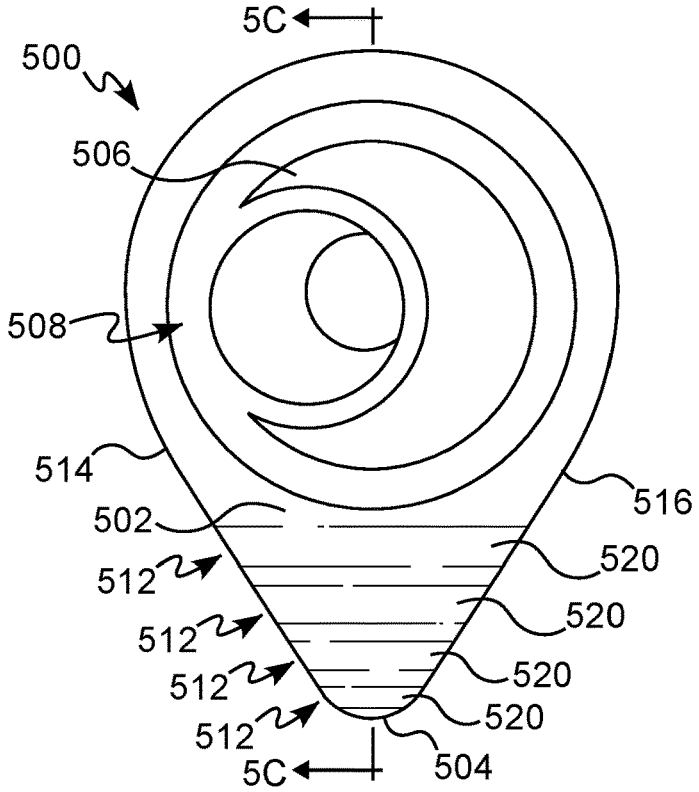
FIG. 5B is a front elevational view of the musical instrument pick of FIG. 5A.
Figure 5C:
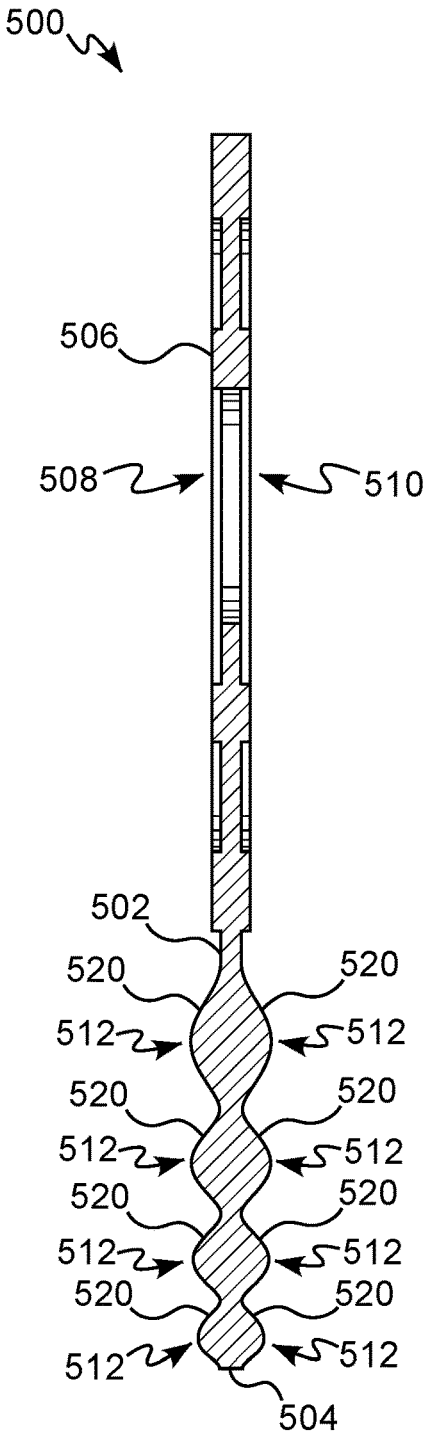
FIG. 5C is a side elevational view of the musical instrument pick of FIG. 5A.

Referring now to FIGS. 5A through 5C, there is seen another exemplary pick 500 in accordance with the subject disclosure. Pick 500 includes a generally planar body having front and rear sides 508, 510, two side edges 514, 516, an acute angled distal end 502 with a curved tip 504, a generally semi-circular proximal end 506 extending proximally from distal end 502, and diametrically opposed raised formations 512 projecting laterally from front and rear sides 508, 510. Raised formations 512 include four pairs of diametrically opposed and substantially curved surfaces on opposite sides 508, 510 that extend substantially the entire width of pick 500 at or near distal end 502, with each curved surface having a curved leading surface 520 to facilitate substantially unhindered passage of raised formations 512 over the string being plucked. The curved surfaces of raised formations 512 are shaped such that a side cross-section of formations 512 resembles a sinusoidal wave (see FIG. 5C) having an increasing frequency toward distal end 502, though it should be appreciated that the curved surfaces may be shaped to resemble a sinusoidal wave having a constant frequency or a frequency that decreases toward distal end 502. In this manner, when either side 508, 510 of pick 500 is used to pluck a string at a 0-degree angle of attack, the four raised formations 512 on that side strike the string four times in rapid succession, thereby producing a desired sound enhancement. A different sound enhancement may be achieved by plucking pick 500 against the string at a different angle of attack to change the sequence, manner and/or speed by which raised formations 512 strike the string.

Figure 6A:
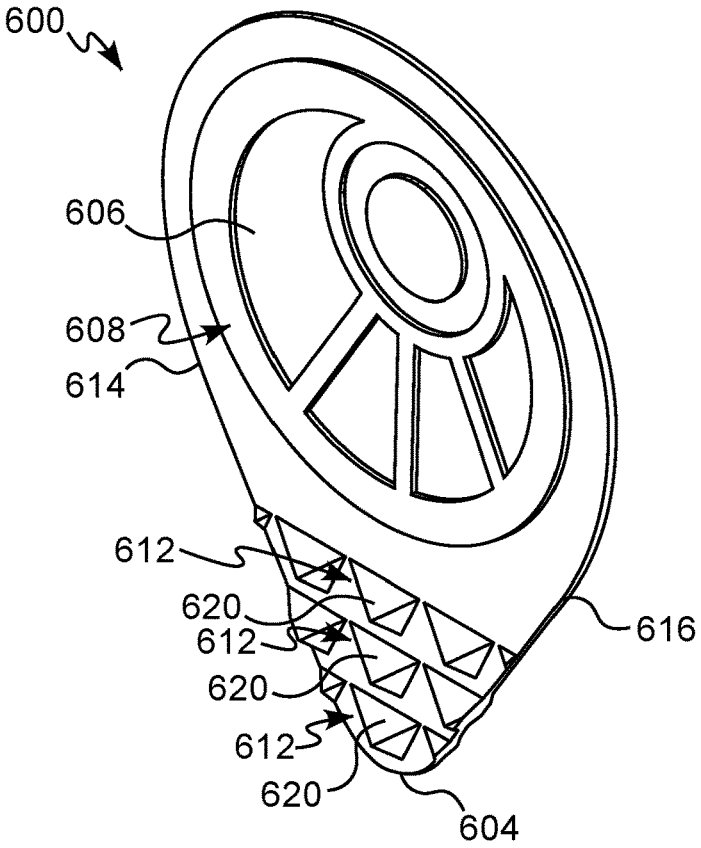
FIG. 6A is a perspective view of a musical instrument pick in accordance with another exemplary embodiment of the subject disclosure.
Figure 6B:
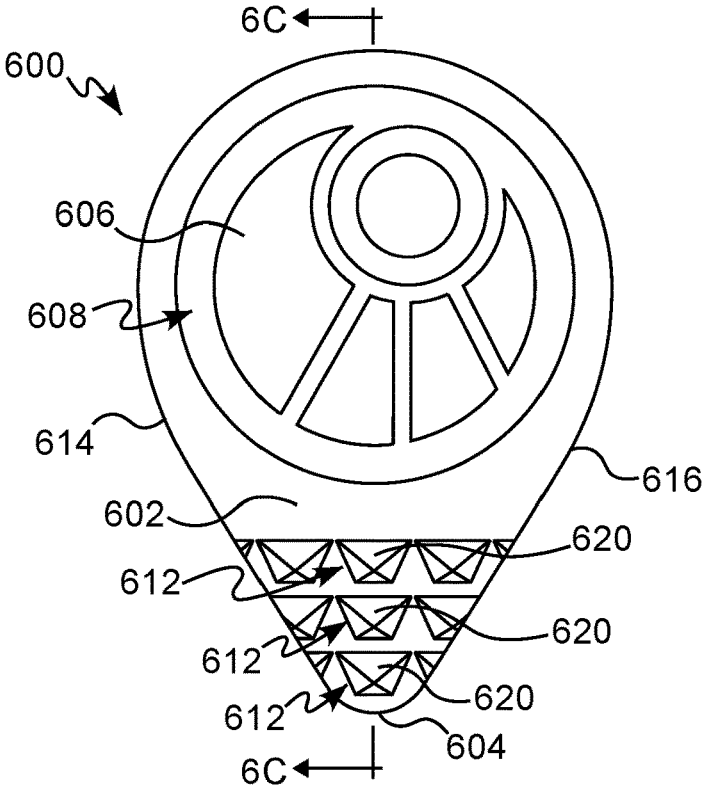
FIG. 6B is a front elevational view of the musical instrument pick of FIG. 6A.
Figure 6C:
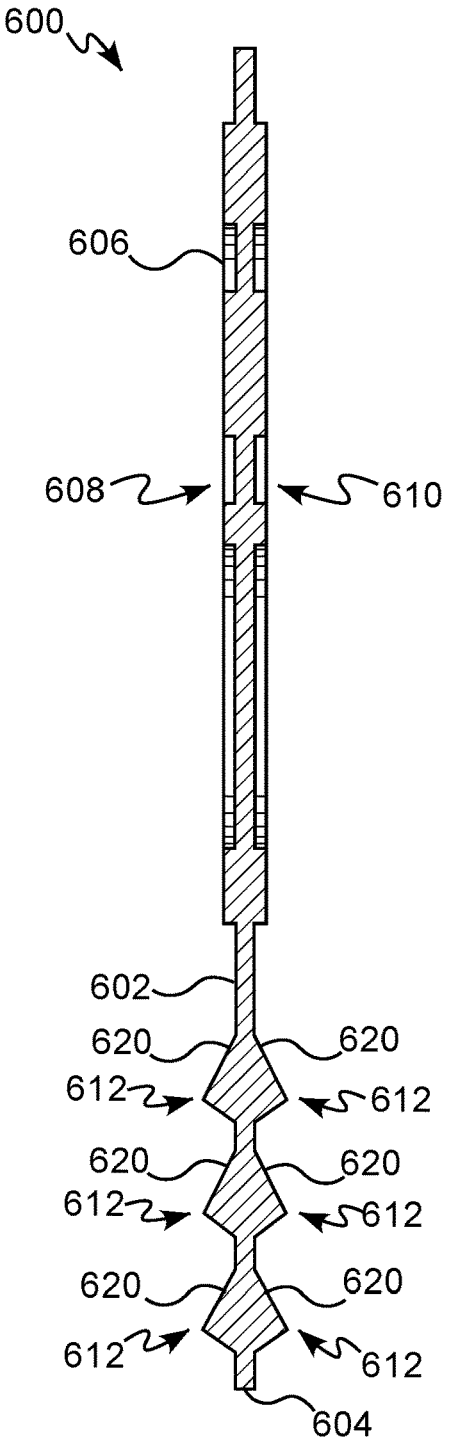
FIG. 6C is a side elevational view of the musical instrument pick of FIG. 6A.

Referring now to FIGS. 6A through 6C, there is seen another exemplary pick 600 in accordance with the subject disclosure. Pick 600 includes a generally planar body having front and rear sides 608, 610, two side edges 614, 616, an acute angled distal end 602 with a curved tip 604, a generally semi-circular proximal end 606 extending proximally from distal end 602, and diametrically opposed raised formations 612 projecting laterally from front and rear sides 608, 610. Raised formations 612 include three pairs of diametrically opposed rows of four-sided pyramids that extend substantially the entire width of pick 600 at or near distal end 602, with the most proximally facing side of each pyramid forming an enlarged and gradually sloping leading surface 620 to facilitate substantially unhindered passage of raised formations 612 over the string being plucked. The pyramids project laterally to substantially the same height on both sides 608, 610 of the planar body. In this manner, when either side 608, 610 of pick 600 is used to pluck a string at a 0-degree angle of attack, the three rows of pyramids on that side strike the string three times in rapid succession, thereby producing a desired sound enhancement.

Since each row of raised formations 612 includes multiple pyramids rather than a single contiguous formation, pick 600 may be used to strike the string more than three times and with different strike patterns by changing the angle of attack between pick 600 and the string. For example, if a user plucks the string using a side edge 614, 616 of pick 600, the pyramids will strike the string successively in an alternating and different pattern compared to a pluck of the string at a 0-degree angle of attack. In this manner, pick 600 may be used to provide a variety of different sound enhancements depending on the angle of attack of pick 600 relative to the string being plucked.

Figure 7A:
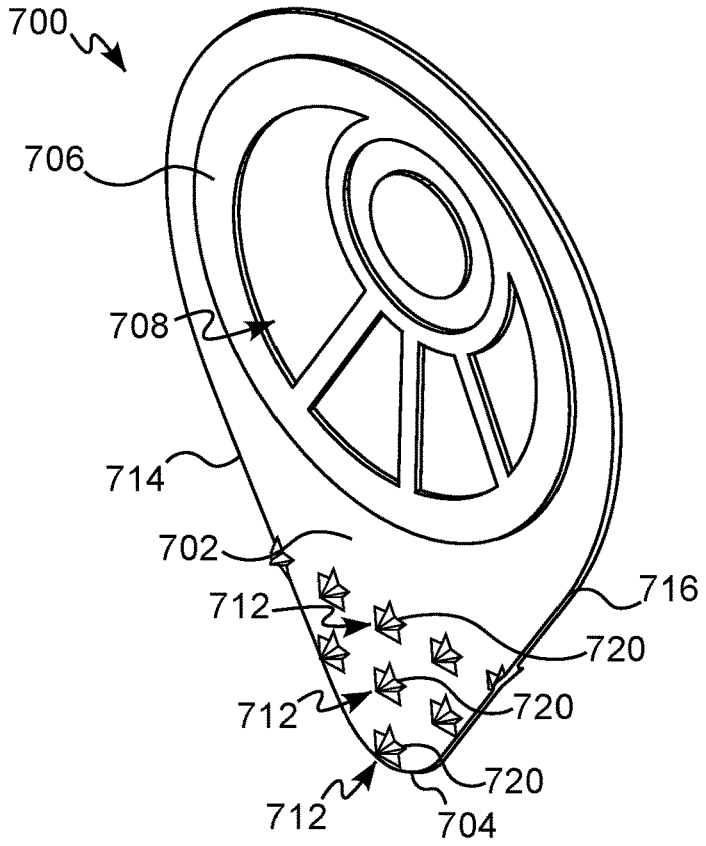
FIG. 7A is a perspective view of a musical instrument pick in accordance with another exemplary embodiment of the subject disclosure.
Figure 7B:
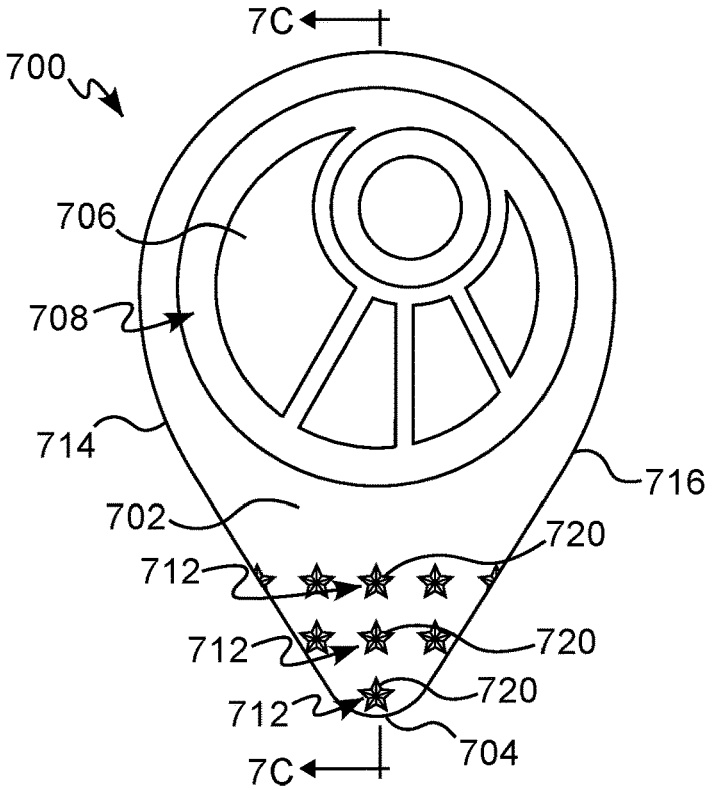
FIG. 7B is a front elevational view of the musical instrument pick of FIG. 7A.
Figure 7C:
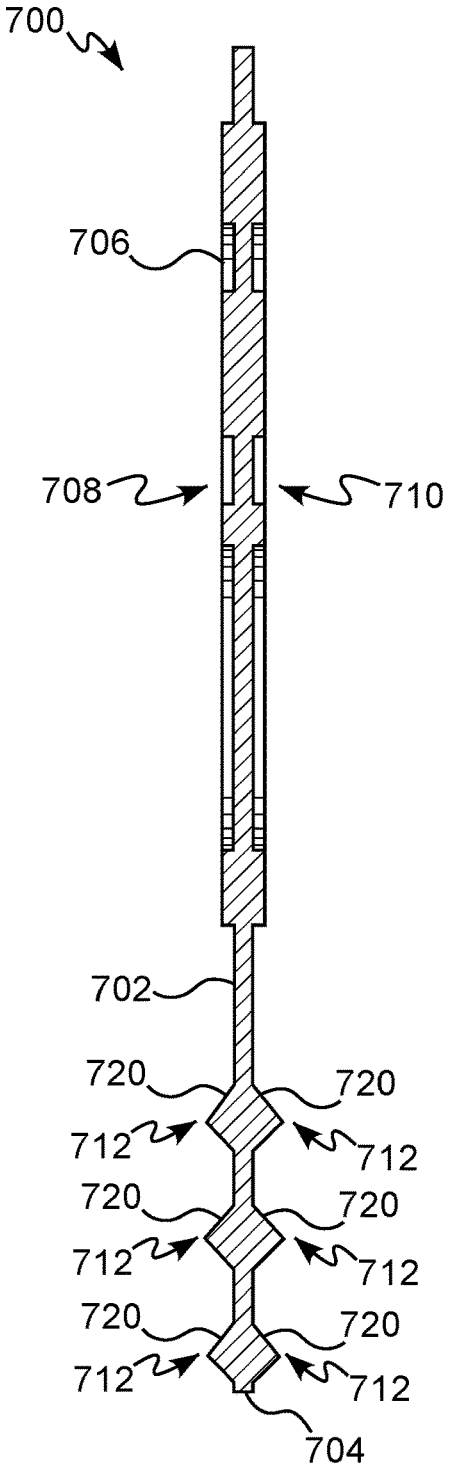
FIG. 7C is a side elevational view of the musical instrument pick of FIG. 7A.

Referring now to FIGS. 7A through 7C, there is seen another exemplary pick 700 in accordance with the subject disclosure. Pick 700 includes a generally planar body having front and rear sides 708, 710, two side edges 714, 716, an acute angled distal end 702 with a curved tip 704, a generally semi-circular proximal end 706 extending proximally from distal end 702, and diametrically opposed raised formations 712 projecting laterally from front and rear sides 708, 710 (three raised formations 712 on each side 708, 710 are referenced in the Figures). Raised formations 712 include three pairs of diametrically opposed rows of five-pointed stars that extend substantially the entire width of pick 700 at or near distal end 702, with the most proximally facing point of each star forming a generally edge-like leading surface 720 between two sloped sides of the point to facilitate substantially unhindered passage of raised formations 712 over the string being plucked. The stars project laterally to substantially the same height on both sides 708, 710 of the planar body. In this manner, when either side 708, 710 of pick 700 is used to pluck a string at a 0-degree angle of attack, the three rows of stars on that side strike the string three times in rapid succession, thereby producing a desired sound enhancement.

Since each row of raised formations 712 includes multiple stars rather than a single contiguous formation, pick 700 may be used to strike the string more than three times and with different strike patterns by changing the angle of attack between pick 700 and the string. For example, if a user plucks the string using a side edge 714, 716 of pick 700, the stars will strike the string successively in an alternating and different pattern compared to a pluck of the string at a 0-degree angle of attack. In this manner, pick 700 may be used to provide a variety of different sound enhancements depending on the angle of attack of pick 700 relative to the string being plucked.

Figure 8A:
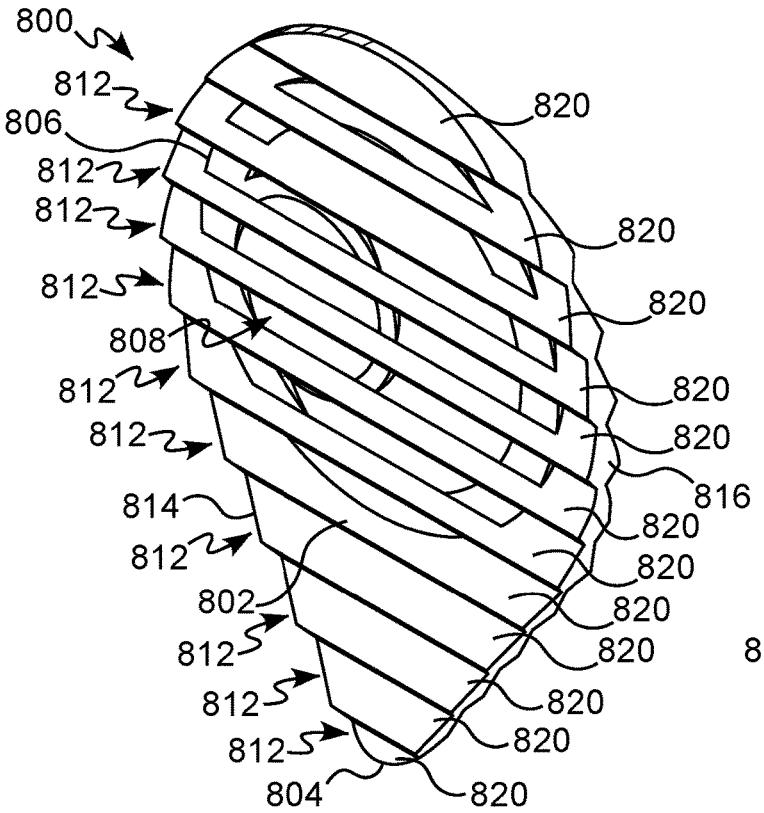
FIG. 8A is a perspective view of a musical instrument pick in accordance with another exemplary embodiment of the subject disclosure.
Figure 8B:
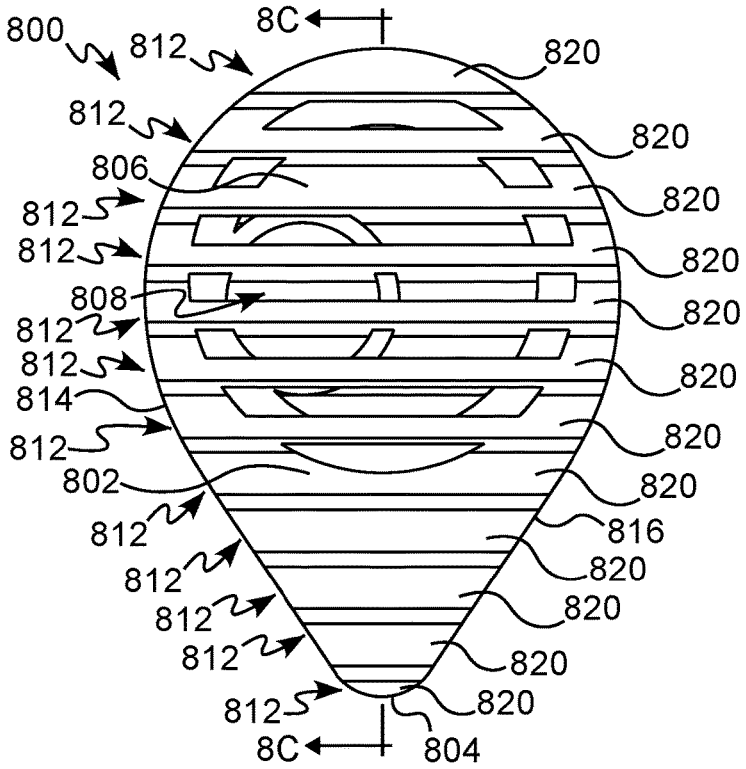
FIG. 8B is a front elevational view of the musical instrument pick of FIG. 8A.
Figure 8C:
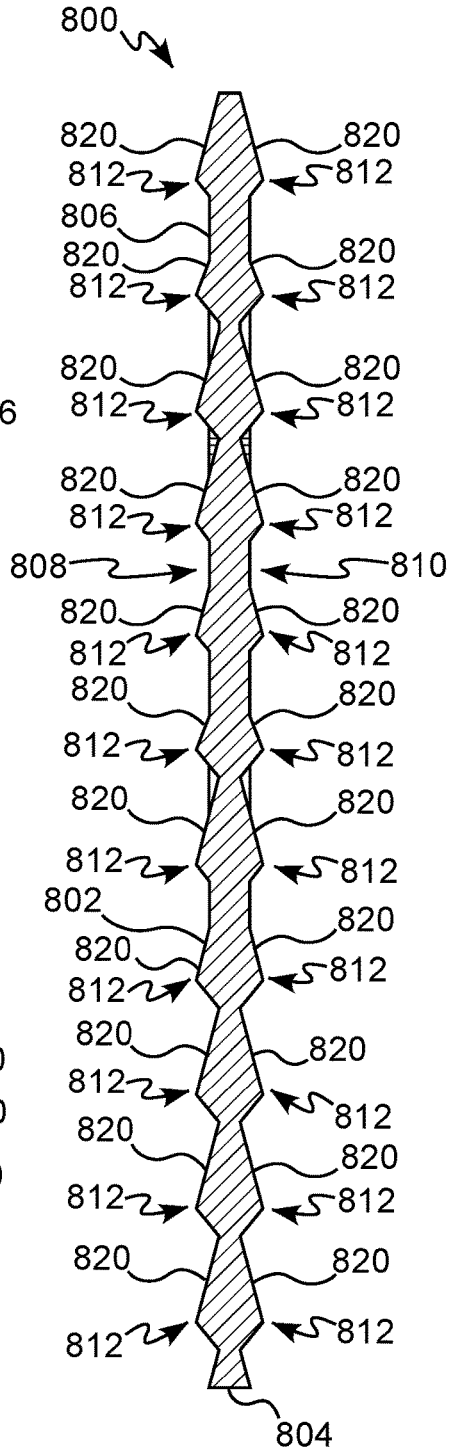
FIG. 8C is a side elevational view of the musical instrument pick of FIG. 8A.

Referring now to FIGS. 8A through 8C, there is seen another exemplary pick 800 in accordance with the subject disclosure. Pick 800 includes a generally planar body having front and rear sides 808, 810, two side edges 814, 816, an acute angled distal end 802 with a curved tip 804, a generally semi-circular proximal end 806 extending proximally from distal end 802, and diametrically opposed raised formations 812 projecting laterally from front and rear sides 808, 810. Raised formations 812 include pairs of diametrically opposed and substantially triangular ridges on opposite sides 808, 810 that extend substantially the entire width of pick 800 and cover substantially the entire surface area of sides 808, 810, with each ridge including a gradually sloped and proximally facing leading surface 820 to facilitate substantially unhindered passage of the raised formation 812 over the string being plucked. The ridges of each pair of formations 812 project laterally on opposite sides 808, 810 of the planar body to substantially the same height. In this manner, when either side 808, 810 of pick 800 is used to pluck a string at a 0-degree angle of attack, the raised formations 812 on that side strike the string multiple times in rapid succession, thereby producing a desired sound enhancement. A different sound enhancement may be achieved by plucking pick 800 against the string at a different angle of attack to change the sequence, manner and/or speed by which raised formations 812 strike the string.

Referring now to FIGS. 9A through 9C, there is seen another exemplary pick 900 in accordance with the subject disclosure. Pick 900 includes a generally planar body having front and rear sides 908, 910, two side edges 914, 916, an acute angled distal end 902 with a curved tip 904, a generally semi-circular proximal end 906 extending proximally from distal end 902, and diametrically opposed raised formations 912 projecting laterally from front and rear sides 908, 910. Raised formations 912 include pairs of diametrically opposed curved ridges that extend substantially the entire width of the pick on opposite sides 908, 910 and cover substantially the entire surface area of sides 908, 910, with each ridge including a sloped and proximally facing leading surface 920 to facilitate substantially unhindered passage of the raised formation 912 over the string being plucked. The curved ridges of each pair of formations 912 project laterally on opposite sides 908, 910 of the planar body to substantially the same height. In this manner, when either side 908, 910 of pick 900 is used to pluck a string at a 0-degree angle of attack, the curved raised formations 912 on that side strike the string multiple times in rapid succession, thereby producing a desired sound enhancement. A different sound enhancement may be achieved by plucking pick 900 against the string at a different angle of attack to change the sequence, manner and/or speed by which raised formations 912 strike the string.

Figure 10A:
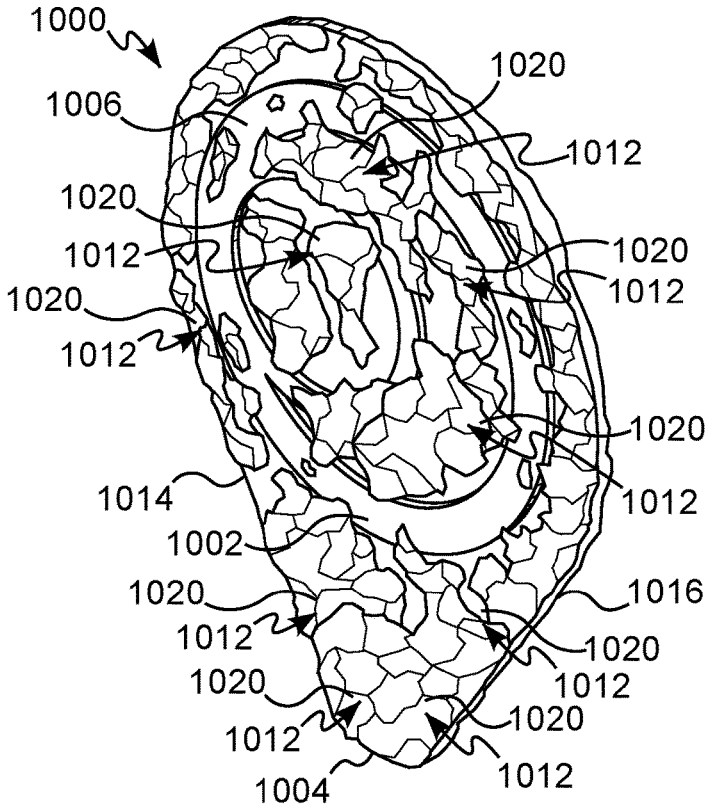
FIG. 10A is a perspective view of a musical instrument pick in accordance with another exemplary embodiment of the subject disclosure.
Figure 10B:
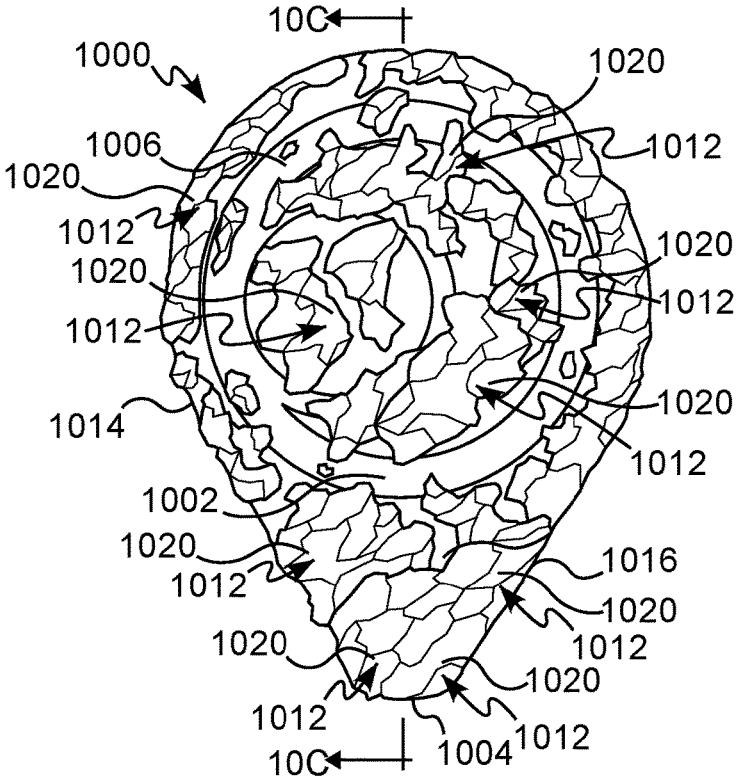
FIG. 10B is a front elevational view of the musical instrument pick of FIG. 10A.
Figure 10C:
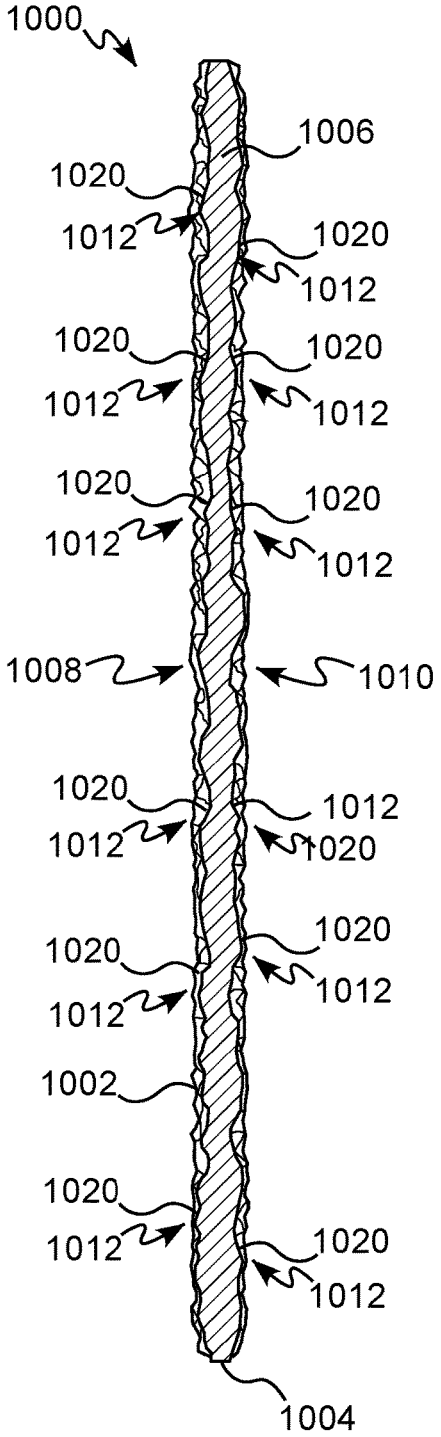
FIG. 10C is a side elevational view of the musical instrument pick of FIG. 10A.
Figure 11A:
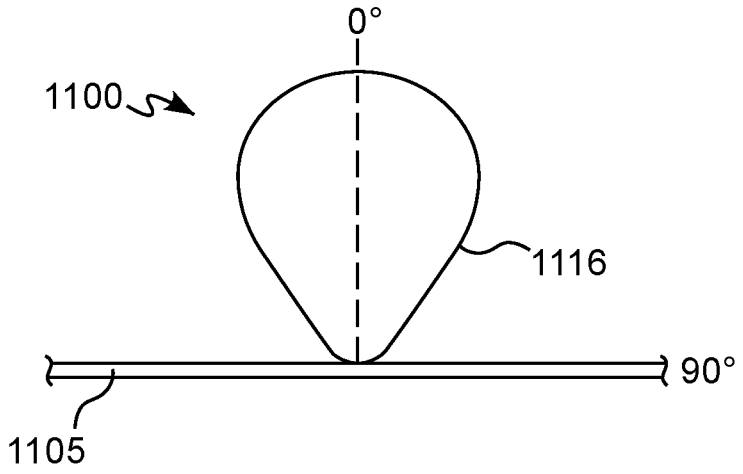
FIG. 11A shows a musical instrument pick striking a string at a 0-degree angle of attack.
Figure 11B:
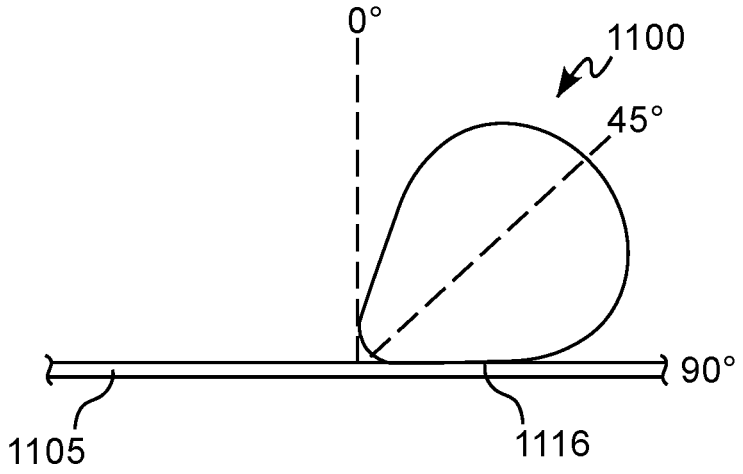
FIG. 11B shows the musical instrument pick of FIG. 11A striking a string at a 45-degree angle of attack.

Referring now to FIGS. 10A through 10C, there is seen another exemplary pick 1000 in accordance with the subject disclosure. Pick 1000 includes a generally planar body having front and rear sides 1008, 1010, two side edges 1014, 1016, an acute angled distal end 1002 with a curved tip 1004, a generally semi-circular proximal end 1006 extending proximally from distal end 1002, and raised formations 1012 projecting laterally from front and rear sides 1008, 1010 (fewer than all raised formations 1012 on each side 1008, 1010 are referenced in the Figures). Raised formations 1012 include a plurality randomly arranged textures or bumps that extend substantially the entire width of the pick on opposite sides 1008, 1010 and cover most of the surface area of sides 1008, 1010, with at least some of the textures or bumps including sloped and proximally facing leading surfaces 1020 to facilitate substantially unhindered passage of the raised formation 1012 over the string being plucked. The textures or bumps of formations 1012 project laterally on opposite sides 1008, 1010 of the planar body to random heights. In this manner, when either side 1008, 1010 of pick 1000 is used to pluck a string at a 0-degree angle of attack, formations 1012 on that side strike the string multiple times in rapid succession, thereby producing a desired sound enhancement. A different sound enhancement may be achieved by plucking pick 1000 against the string at a different angle of attack to change the sequence, manner and/or speed by which raised formations 1012 strike the string.

It will be appreciated by those skilled in the art that changes could be made to the exemplary embodiments described above without departing from the broad inventive concept thereof. It is to be understood, therefore, that this disclosure is not limited to the particular embodiments disclosed, but it is intended to cover modifications within the spirit and scope of the subject disclosure as defined by the appended claims.

We claim:

1. A pick for plucking a string of a stringed musical instrument, comprising:

a planar body having front and rear sides, wherein each of the front and rear sides defines a planar surface;

a distal end having a tip for plucking the string, a proximal end for gripping by a user; and a plurality of raised formations extending from the planar surface of at least one of the front and rear sides of the planar body at the distal end, the raised formations being arranged in non-overlapping rows extending transverse to an axis extending longitudinally along a length of the planar body from the tip to the proximal end.

2. The pick of claim 1, wherein each of the plurality of raised formations projects laterally from the distal end to a height of about 1.0 to 2.5 mm.

3. The pick of claim 1, wherein the plurality of raised formations is provided on substantially an entirety of at least one of the front and rear sides.

4. The pick of claim 1, wherein the plurality of raised formations includes curved or sloped leading surfaces to facilitate substantially unhindered passage of the raised formations over the string.

5. The pick of claim 1, wherein the raised formations are of substantially equal height.

6. The pick of claim 1, wherein the raised formations decrease in height toward the proximal end.

7. The pick of claim 1, wherein the raised formations increase in height toward the proximal end.

8. The pick of claim 1, wherein the plurality of raised formations includes triangular ridges.

9. The pick of claim 1, wherein the plurality of raised formations includes spheroids.

10. The pick of claim 9, wherein the spheroids are substantially the same size.

11. The pick of claim 9, wherein the spheroids are different sizes.

12. The pick of claim 1, wherein a side cross-section of the plurality of raised formations resembles a sinusoidal wave.

13. The pick of claim 12, wherein the sinusoidal wave has a frequency that increases toward the distal end.

14. The pick of claim 1, wherein the plurality of raised formations includes pyramids.

15. The pick of claim 1, wherein the plurality of raised formations includes stars.

16. The pick of claim 15, wherein each of the stars are five-pointed stars.

17. The pick of claim 1, wherein the plurality of raised formations includes curved ridges.

18. The pick of claim 1, wherein the plurality of raised formations includes randomly arranged bumps.

* * * * *